United States Patent [19]

Dalrymple et al.

[11] Patent Number: 4,941,410

[45] Date of Patent: Jul. 17, 1990

[54] OUTLET VALVE ASSEMBLY WITH AN EXTENDED HANDLE FOR A RAILWAY TANK CAR

[75] Inventors: Thomas H. Dalrymple, Crown Point; Richard L. Zagrocki, Griffith, both of Ind.

[73] Assignee: Union Tank Car Company, East Chicago, Ind.

[21] Appl. No.: 257,423

[22] Filed: Oct. 13, 1988

[51] Int. Cl.[5] ..... B61D 5/00; F16K 51/00; F16K 31/00

[52] U.S. Cl. ..... 105/358; 251/144; 251/293

[58] Field of Search ..... 105/358, 360; 410/68; 251/144, 231, 232, 293

[56] References Cited

U.S. PATENT DOCUMENTS

| | | | |
|---|---|---|---|
| 275,042 | 4/1883 | Heysinger | 251/293 X |
| 1,002,351 | 9/1911 | Wilson | 251/293 X |
| 1,227,096 | 5/1917 | Vincent et al. | 251/293 X |
| 1,369,111 | 2/1921 | Jacobs et al. | 251/144 X |
| 3,227,101 | 1/1966 | Holden | 105/358 |
| 3,326,141 | 6/1967 | Graves | 105/358 |
| 3,406,700 | 10/1968 | Beazer et al. | 251/144 X |
| 4,220,097 | 9/1980 | Wempe et al. | 105/360 |
| 4,397,444 | 8/1983 | Behle | 251/144 |
| 4,422,473 | 12/1983 | Polley | 251/144 |
| 4,495,963 | 1/1985 | Hensley | 251/293 X |
| 4,527,489 | 7/1985 | Schlink | 105/358 |
| 4,678,159 | 7/1987 | Gardner et al. | 251/144 X |

OTHER PUBLICATIONS

Drawing entitled "Bottom Outlets".
Drawing entitled "UTLX Design Details".
Drawing entitled "B.O.V. Handle and Bracket Installation 557-60-CS, (Rev. 11/86)".

*Primary Examiner*—Robert J. Oberleitner
*Attorney, Agent, or Firm*—Dressler, Goldsmith, Shore, Sutker & Milnamow

[57] ABSTRACT

An outlet valve assembly is provided for a railway tank car. The valve is mounted at the bottom of the tank car for discharging downwardly between the tracks. The valve is operable between the closed position to occlude flow through the valve and an opened position to permit flow through the valve. A shaft is operably connected to, and extends from, the valve on a horizontal axis normal to the length of the tank car for being rotated on the axis to operate the valve between the closed and opened positions. A handle is connected to the shaft at a predetermined distance from the valve, and the handle extends generally radially outwardly from the shaft. The valve is operated between the closed and opened positions when the handle is swung through an arc from an initial orientation to a final orientation. The length of the handle and the predetermined distance between the valve and handle connection is selected such that the handle can be swung between the initial and final orientations by a person standing upright beside the tank car outside of the tracks.

5 Claims, 2 Drawing Sheets

OUTLET VALVE ASSEMBLY WITH AN EXTENDED HANDLE FOR A RAILWAY TANK CAR

TECHNICAL FIELD

This invention relates to a manually actuated outlet valve for use on a railway tank car.

BACKGROUND OF THE INVENTION AND TECHNICAL PROBLEMS POSED BY THE PRIOR ART

Conventional railway tank cars are typically provided with an outlet valve at the bottom of the tank for discharging the liquid contents from the tank. Such a bottom outlet valve is typically of the ball valve type and is usually provided with an appropriate outlet adaptor (nozzle) for connection to a pipe, hose, or other conduit for discharging the railway tank car fluid product to a receiving container.

One type of outlet adaptor in use today with bottom outlet valves is a threaded nozzle which is normally capped with a matingly engaged threaded cap. When it is desired to discharge the product from the railway tank car, the cap is unthreaded from the nozzle, and a hose is threaded onto the end of the nozzle in place of the cap.

When the fluid product is to be discharged through a bottom outlet valve operated by means of a conventional handle connected to the valve, the person operating the handle to open the valve must be positioned relatively close to the valve, and hence, relatively close to the connection of the hose to the nozzle on the outlet of the valve. Typically, the person must crouch down or sit beneath part of the railway tank car between the tracks to reach the valve operating handle This is awkward and strenuous. In view of this it would be desirable to provide a bottom outlet valve assembly that would not require the person to crouch or sit beneath the tank car.

One approach to avoid having the operating person crouch beneath the tank car has been to provide valve operating mechanisms extending upwardly from the valve through the tank to the top of the tank car. The person operating the valve would then do so from the top of the tank car. However, the person operating the valve on the top of the tank car is unable to observe the connection of the hose to the outlet valve nozzle and is thus unable to notice any problems at the connection. Of course, this also requires the valve operator to climb up to the top of the tank car, and this in itself is still inefficient.

Thus, it would be desirable to provide an improved outlet valve assembly with remote operating means so that the person need not crouch beneath the tank car, but can still be adjacent the tank car.

It would also be advantageous if the outlet valve assembly could be operated in a manner that would permit the person operating the valve to still view the hose connection while opening and closing the valve.

SUMMARY OF THE INVENTION

An outlet valve assembly is provided for a railway tank car. The valve is mounted at the bottom of the tank car for discharging downwardly between the tracks. The valve is operable between a closed position to occlude flow through the valve and an open position to permit flow through the valve.

A shaft is operably connected to, and extends from, the valve on a horizontal axis normal to the length of the tank car for being rotated on the axis to operate the valve between the closed and open positions.

A handle is connected to the shaft at a predetermined distance from the valve, and the handle extends generally radially outwardly from the shaft. The valve is operated between the closed and open positions when the handle is swung through an arc from an initial orientation to a final orientation. The length of the handle and the predetermined distance between the valve and handle connection is selected such that the handle can be swung between the initial and final orientations by a person located beside the tank car outside of the tracks.

Preferably, the valve is of the type that is operated by rotating the handle through about 90 degrees to move the valve between the closed and open positions. The handle has an initial, upwardly angled, non-vertical orientation when the valve is closed. Thus, when the valve is closed, the handle can be conveniently grasped by an erect person of average height standing beside the railway tank car outside of the tracks.

When opening the valve, the handle is swung from the initial orientation through a horizontal orientation to a final, downwardly angled, non-vertical orientation where the valve is fully open. When the handle is in the final orientation with the valve fully open, the end of the handle can still be conveniently grasped by the person while bending at the waist, and the person can simultaneously observe the valve from beside the tank outside of the tracks.

Numerous other advantages and features of the present invention will become readily apparent from the following detailed description of the invention, from the claims, and from the accompanying drawings

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENT

While this invention is susceptible of embodiment in many different forms, this invention and the accompanying drawings disclose only one specific form as an example of the use of the invention. The invention is not intended to be limited to the embodiment so described, and the scope of the invention will be pointed out in the appended claims.

Some of the figures illustrating the preferred embodiment of the apparatus show structural details and mechanical elements that will be recognized by one skilled in the art. However, the detailed descriptions of some of these elements are not necessary to an understanding of the invention, and accordingly, are not herein presented.

Figure 1:
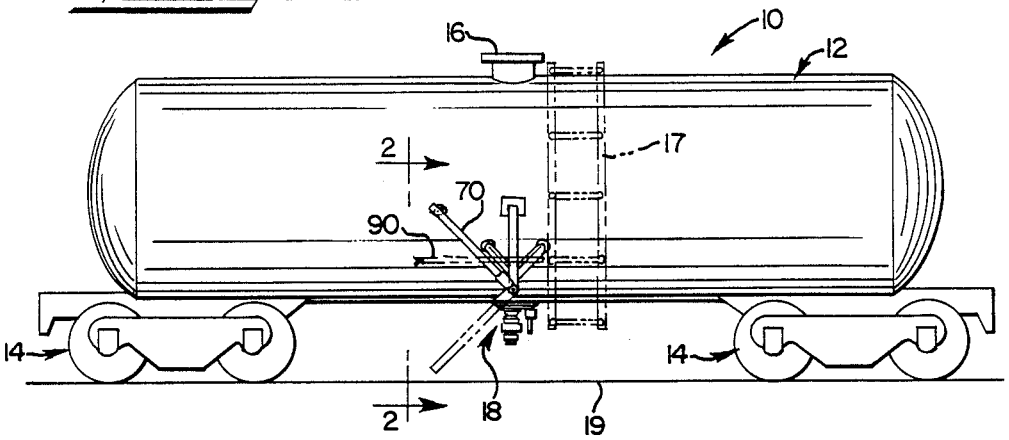
FIG. 1 is a side elevational view of a railway tank car on railroad tracks, and the railway tank car includes the outlet valve assembly of the present invention.
Figure 2:
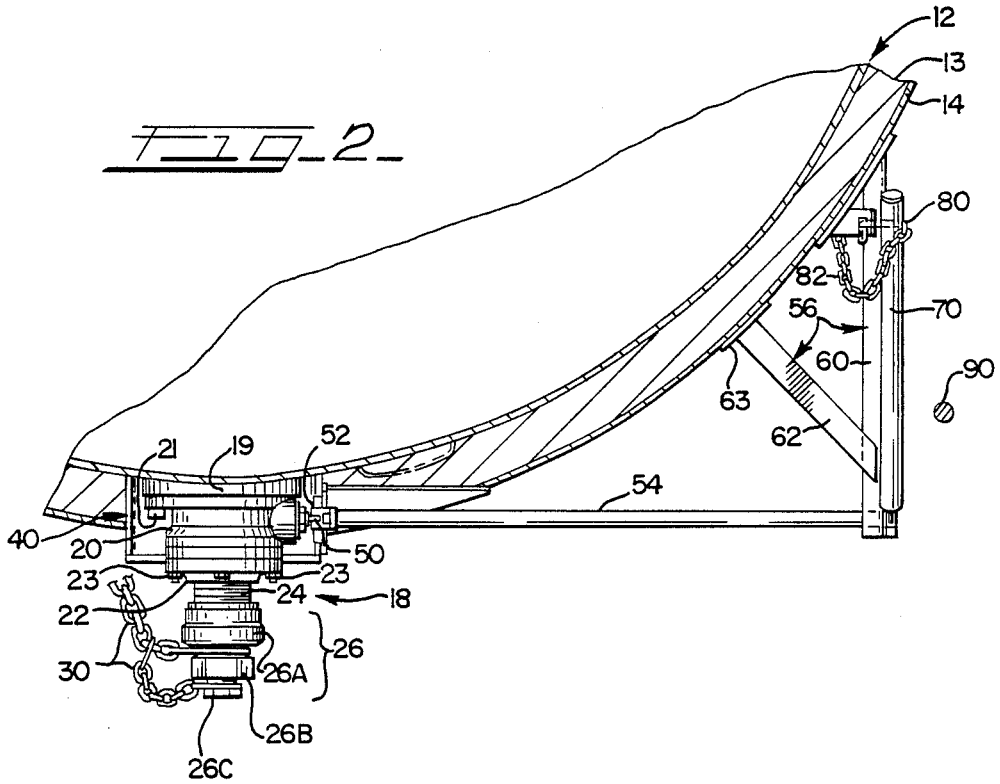
FIG. 2 is a greatly enlarged, fragmentary, cross-sectional view taken generally along the plane 2—2 in FIG. 1.

Referring to FIG. 1, a railway tank car 10 is shown of a generally conventional construction and arrangement. More particularly, the railway tank car 10 includes a conventional elongated cylindrical tank body or tank 12 supported at its oppositely disposed ends by substantially identical wheel trucks 14 of generally conventional construction above railway tracks 19. The tank 12 has a top manway 16, extending upwardly from an upper portion of the tank, and has an external bottom operable outlet valve assembly 18 extending downwardly from the bottom of the tank at the transverse center line. As best illustrated in FIG. 2, the tank 12 may be provided with insulation 13 and an external jacket 15. An optional ladder 17 is shown in dashed line.

As best illustrated in FIG. 2, the valve assembly 18 includes a valve 20 mounted to the tank bottom outlet 19 (e.g., by studs 21 or the like), and a nozzle 22 mounted to the outlet of the valve 20 (e.g., by studs and nuts 23 or the like). The nozzle 22 has a threaded end portion 24 which is normally capped with a threadingly engaged cap assembly 26. The cap assembly 26 has an enlarged, internally threaded, female collar 26A for being screwed onto the nozzle portion 24. The cap assembly 26 also has a reduced diameter, internally threaded, end portion 26B into which is threaded a plug 26C. The cap assembly 26 is connected via a chain 30 to a portion of the tank (not illustrated). Removal of the cap assembly 26 exposes the nozzle end portion 24 and permits a conventional hose or other conduit 28 to be threaded onto the nozzle end portion 24.

As best illustrated in FIG. 2, the valve 20 includes a housing defining a downwardly opening outlet to which the nozzle 22 is connected so that the tank contents can be discharged generally vertically downwardly. When the tank car is normally located on railway tracks, the valve 20 is located generally between, but above, the tracks. The valve 20 is operable between a closed position to occlude the valve and an open position to permit flow through the valve. In the preferred embodiment of the invention, the valve is of the type that has an internal valve member and actuator mechanism (not visible) that can be operated through about 90 degrees to move the valve between the closed and open positions.

One type of valve that may be used in the present invention is a ball valve. Such a ball valve may be of a special design or may be of a conventional design. One suitable conventionally designed ball valve is sold under the trade name UTLX Low-Profile Ball Valve sold in the U.S.A. by the Union Tank Car Company, 151st. Street and Railroad Avenue, East Chicago, Ind. 46312, U.S.A. This valve quickly opens and closes with only a quarter turn of the handle. This valve is compatible with most external valve saddles now in service, and as best illustrated in FIG. 2, is adapted to be mounted within a conventional skid assembly 40 which is mounted to the bottom of the tank 12 and which serves to protect the valve 20 and other appurtenances which extend from the bottom of the tank 12.

The actuator mechanism for operating the valve member within the valve 20 includes a valve stem 50 as best illustrated in FIG. 2. A conventional shaft coupling 52 is engaged with the distal end of the valve stem 50 and serves to couple the valve stem 50 to an extension shaft 54. The extension shaft 54 extends outwardly from the valve stem 50 in a generally coaxial or colinear relationship.

Preferably, the outer portion of the extension shaft 54 is supported by a support means or bracket assembly 56. The bracket assembly 56 includes a generally vertically oriented channel 60 provided with an aperture for receiving the distal end of the extension shaft 54. The bracket assembly 56 also preferably includes a pair of angled struts 62 which are connected to opposite sides of the vertical channel 60. The top ends of the struts 62 and the top end of the vertical channel 60 are anchored to pads 63 on the tank or on the exterior of the tank jacket 14.

Although not visible in the figures, the lower end of the vertical channel 60 may carry a bearing and appropriate packing washers as may be necessary for receiving the distal end of the extension shaft 54 and accommodating rotation of the shaft 54.

Figure 3:
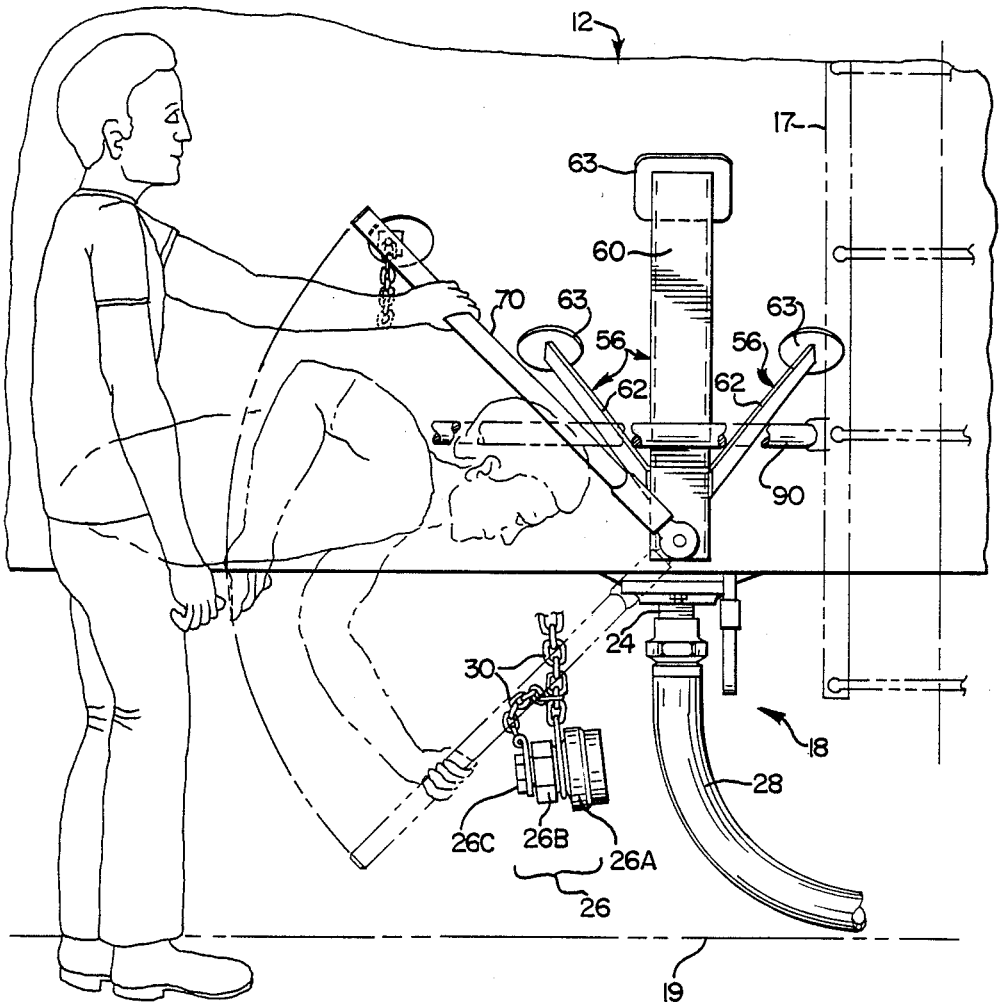
FIG. 3 is a fragmentary, side elevational view of the outlet valve assembly of the present invention shown being operated by a person standing beside the tank car outside of the tracks.

A handle 70 is connected to the end of the extension shaft 54 at a predetermined distance from the valve 20. The handle 70 extends generally radially outwardly from the shaft 54 and is connected to the shaft at an orientation relative to the open and closed positions of the valve 20 such that the valve 20 is operated between the closed and open positions when the handle is swung through an arc of about 90 degrees from an initial, non-vertical orientation (illustrated in solid lines in FIG. 3) through a horizontal orientation to a final, non-vertical orientation (illustrated in dashed lines in FIG. 3).

Preferably, the length of the handle 70 and the predetermined distance between the valve 20 and the handle connection to the shaft 54 is selected such that (1) when the handle 70 is in the initial orientation, the distal end of the handle 70 is spaced from the exterior of the tank and can be conveniently grasped by an erect person of average height standing beside the tank outside of the tracks; and (2) when the handle 70 is in the final orientation, the distal end of the handle 70 can be conveniently grasped by the person bending at the waist who can simultaneously observe the valve 20 from beside the tank 12 outside of the tracks.

The handle 70 may be secured in the elevated, closed position by means of a conventional, locking swing pin 80 attached to the tank 12 by means of a chain 82.

In the preferred embodiment of the outlet valve assembly illustrated, the horizontal axis of the shaft 54 is a minimum of 2 feet, 7 inches above the top of the track rails. The handle 70 is attached to the shaft 54 at a distance of about 4 feet, 5 inches from the center line of the valve 20. The length of the handle 70 is about 3 feet. Preferably, in the fully closed position of the valve, the handle 70 extends upwardly at about a 45 degree angle from the vertical orientation alongside the tank 12. When the valve is in the fully opened position, the handle 70 is angled downwardly below the tank 12 at about 45 degrees from a vertical orientation.

Preferably, a side safety rail 90 is provided just outwardly of the handle 70 to allow hand clearance when operating the valve.

It is seen that the present invention thus permits the person operating the valve 20 to be located a distance from the hose connection sufficient to enable the person to stand outside of the tracks.

Further, the person operating the valve can do so without crouching, sitting, or kneeling below the tank car 10.

In addition, when a quarter-turn valve is used, the person can operate the valve from full closed to full open while standing in one place and merely bending at the waist. Further, as the valve handle is being moved into the open position, the person is able to conveniently view the hose connection.

This invention also permits the use of a much longer handle (up to about twice as long as conventional handles) since there is sufficient space to swing the handle 90 degrees adjacent the tank car 10. This is important since some valves can be difficult to operate, especially by women who are now more often employed at many loading/unloading racks or stations.

It will be readily observed from the foregoing detailed description of the invention and from the illustrated embodiment thereof that numerous variations and modifications may be effected without departing from the true and spirit and scope of the novel concepts or principles of this invention.

What is claimed is:

1. In a railway tank car having a generally cylindrical tank supported at its oppositely disposed ends on trucks disposed to ride on railway tracks, an outlet valve assembly comprising:

a valve mounted at the bottom of said cylindrical tank for discharging downwardly between the railway tracks and operable between a closed position to occlude flow through said valve and an open position to permit flow through said valve, a shaft operably connected to and extending from said valve on a horizontal axis perpendicular to the longitudinal axis to operate said valve between said closed and open positions;

a support means mounted to said tank for supporting said shaft at a region spaced from said valve, said support means includes a bracket assembly comprising a generally vertically oriented channel for receiving a distal end of said shaft, said bracket assembly further includes an upwardly angled strut connecting said channel to said tank; and a handle connected to said shaft at a predetermined distance from said valve for rotation of said shaft, said handle extending generally radially outwardly from said shaft, said handle extending generally radially outwardly from said shaft and connected to said shaft such that swinging of said handle through an arc in a plane parallel to the longitudinal axis of said cylindrical tank is operative to move said valve between said closed and open positions as said handle is swung from an initial orientation to a final orientation, the length of said handle and said predetermined distance between said valve and said handle connection to said shaft being such as to permit a person to swing said handle between its initial orientation and its final orientation while standing outside of the railway tracks.

2. The outlet valve assembly in accordance with claim 1 in which said handle is connected to said shaft at a predetermined distance of 4 feet, 5 inches from the center line of said valve and in which said handle has a length of 3 feet.

3. The outlet valve assembly in accordance with claim 1 in which said shaft is mounted so that said horizontal axis is at least about 2 feet, 7 inches above the top of the railway tracks.

4. The outlet valve assembly in accordance with claim 1 in which said valve is operable between the full closed and full open positions by rotation of said shaft through about 90 degrees and in which said handle is connected to said shaft such that said handle is oriented at about 45 degrees from the vertical when the valve is full closed and is oriented at about 45 degrees from the vertical when the valve is full open.

5. In a railway tank car having a generally cylindrical tank supported at its oppositely disposed ends on trucks disposed to ride on railway tracks, an outlet valve assembly comprising:

a valve mounted at the bottom of said cylindrical tank; said valve having a valve housing defining a downwardly opening outlet port to discharge the cylindrical tank contents generally vertically downwardly between the railway tracks below said cylindrical tank; said valve being operable between a closed position to occlude flow through said valve and an open position to permit flow through said valve; a shaft operably connected to and extending from said valve on a horizontal axis perpendicular to the longitudinal axis of said cylindrical tank for being rotated on said horizontal axis through about 90 degrees to move said valve between said closed and open positions;

support means mounted to said cylindrical tank for supporting said shaft at a region spaced from said valve, said support means includes a bracket assembly comprising a generally vertically oriented channel for receiving a distal end of said shaft, said bracket assembly further includes an upwardly angled strut connecting said channel to said tank;

a handle connected to said shaft at a predetermined distance from said valve for rotation of said shaft; said handle extending generally radially outwardly from said shaft and connected to said shaft such that said valve is operated between said closed and open positions when said handle is swung through an arc of about 90 degrees in a plane parallel to the longitudinal axis of said cylindrical tank from an initial non-vertical orientation through a horizontal orientation to a final non-vertical orientation; the length of said handle and said predetermined distance between said valve and said handle connection to said shaft being such that (1) when said handle is in said initial orientation, the distal end of said handle spaced from the exterior of said tank and can be grasped by an erect person standing beside said cylindrical tank outside of the railway tracks; and (2) when said handle is in said final orientation, the distal end of said handle can be grasped by a person bending at the waist who can simultaneously observe said valve from beside said cylindrical tank while standing outside of said railway tracks.

* * * * *